US005429260A

United States Patent [19]

Vollers

[11] Patent Number: 5,429,260

[45] Date of Patent: Jul. 4, 1995

[54] PRODUCE BOX WITH PLASTIC WALLS

[76] Inventor: Gary L. Vollers, 11471 Tampa Ave., #149, Northridge, Calif. 91326

[21] Appl. No.: 143,637

[22] Filed: Nov. 1, 1993

[51] Int. Cl.[6] ..... B65D 6/22

[52] U.S. Cl. ..... 220/7; 220/6; 220/433; 220/675; 220/666

[58] Field of Search ..... 220/6, 7, 445, 4.33, 220/675, 669, 666, DIG. 14; 229/939

[56] References Cited

U.S. PATENT DOCUMENTS

| | | | |
|---|---|---|---|
| 1,699,130 | 1/1929 | Anderson . | |
| 2,072,672 | 3/1937 | Frost . | |
| 2,551,814 | 5/1951 | Rushing et al. . | |
| 2,633,285 | 3/1953 | Kells . | |
| 2,736,487 | 2/1956 | George . | |
| 3,010,638 | 11/1961 | Forrer . | |
| 3,361,322 | 1/1968 | Gabriel et al. | 229/939 |
| 3,623,650 | 11/1971 | Watts . | |
| 3,632,037 | 1/1972 | Webb et al. . | |
| 3,713,579 | 1/1973 | Chaffers . | |
| 3,905,478 | 9/1975 | Peterson et al. . | |
| 3,905,541 | 9/1975 | Paxton . | |
| 3,921,896 | 11/1975 | Ishimura . | |
| 4,002,261 | 1/1977 | Litchfield | 220/4.33 |
| 4,023,617 | 5/1977 | Carlson et al. | 220/445 |
| 4,187,977 | 2/1980 | Boykin et al. . | |
| 4,230,233 | 10/1980 | Orr . | |
| 4,245,773 | 1/1981 | Stollberg . | |
| 4,251,006 | 2/1981 | Smith . | |
| 4,277,015 | 7/1981 | Crane . | |
| 4,291,830 | 9/1981 | Sorensen . | |
| 4,389,013 | 6/1983 | Hall et al. . | |
| 4,482,074 | 11/1984 | Lalley . | |
| 4,643,314 | 2/1987 | Kidd | 220/6 |
| 4,685,610 | 8/1987 | Carter et al. . | |
| 4,762,270 | 8/1988 | Stoll et al. . | |
| 4,763,833 | 8/1988 | Stoll . | |
| 4,828,894 | 5/1989 | Taylor . | |
| 4,884,739 | 12/1989 | Nederveld . | |
| 4,911,356 | 3/1990 | Townsend et al. . | |
| 4,948,039 | 8/1990 | Amatangelo . | |
| 4,993,623 | 2/1991 | Kelly et al. . | |
| 5,038,998 | 8/1991 | Morris et al. . | |
| 5,116,290 | 5/1992 | Ross . | |
| 5,190,213 | 3/1993 | Horwitz . | |

FOREIGN PATENT DOCUMENTS 2449605 9/1980 France .

OTHER PUBLICATIONS

The Wiley Encyclopedia of Packaging Technology, John Wiley & Sons, pp. 341-346 (1986).

*Primary Examiner*—Stephen J. Castellano
*Attorney, Agent, or Firm*—William W. Haefliger

[57] ABSTRACT

A produce box structure comprising box side walls, bottom wall, and top wall sections, and two end walls, said end walls being substantially rigid for supporting the side walls and bottom wall; the end walls having peripheral edge portions, the bottom wall and side walls overlapping certain of the peripheral edges of the end walls and adhesively joined thereto; all of the walls consisting of lightweight plastic material, the bottom wall, side walls and top wall sections defined by thin inner and outer sheets and webs interconnecting the sheets, the webs extending directionally lengthwise toward the end walls, whereby lengthwise extending elongated cells are formed by the inner and outer sheets and webs; the side walls being integral with the top wall sections, whereby the top wall sections are hingedly connected to the side wall, respectively, and may be opened away from the end walls; and projections on the end walls, to which the top wall sections are releasably connectible.

9 Claims, 4 Drawing Sheets

PRODUCE BOX WITH PLASTIC WALLS

BACKGROUND OF THE INVENTION

This invention relates generally to box structures, as for example are usable for produce (fruit and vegetables) packaging, and more particularly to boxes having walls consisting of plastic, certain of which are foldable, to provide open box tops which then may be rapidly closed by plastic, foldable lids removably attached to box plastic end walls.

Box structure or containers of the above type, as for produce such as grapes (for example), have been utilized employing wooden end walls which are relatively thick, to facilitate nailing, as referred to. However, such boxes must be extremely inexpensive, yet sturdy, whereas the cost of wood has become prohibitive. Efforts have been made, accordingly, to produce and use boxes made of paperboard; however, such boxes tend to entirely collapse when a number of filled boxes are stacked one on top of another, and they become weakened by contact with moisture associated with produce. There is need for improvements in construction of such boxes, enabling use of less expensive plastic materials, impervious to moisture.

SUMMARY OF THE INVENTION

It is a major object of the invention to provide an improved box construction meeting the above needs. Basically, the improved structure comprises:

a) box side walls, bottom wall, and top wall sections, and two end walls, the end walls being substantially rigid for supporting the side walls and bottom wall, b) the end walls having peripheral edge portions, the bottom wall and side walls overlapping certain of the peripheral edges of the end walls and adhesively joined thereto, c) all of the walls consisting of lightweight plastic material, the bottom wall, side walls and top wall sections defined by thin inner and outer sheets and webs interconnecting the sheets, the webs extending directionally lengthwise toward the end walls, whereby lengthwise extending elongated cells are formed by the inner and outer sheets and webs, d) the side walls being integral with the top wall sections, whereby the top wall sections are hingedly connected to the side walls, respectively, and may be opened away from the box interior, e) and projections on the end walls, to which the top wall sections are releasably connectible, to close the box.

Typically, the bottom plastic wall and side plastic walls form a continuous strip which is foldable to fit against peripheral edges of the end walls, the certain peripheral edges being flat; and such folded walls may form a continuous strip, which is cellular or honeycomb-like.

Another object is to provide bottom wall, side walls and top wall sections that define a continuous single wall structure. The peripheral edge of the end walls may define flange structure joined in overlapping relation to edge extents of the bottom wall and side walls. In one form of the invention, the peripheral edges of the end walls define channels receiving edge extents of the bottom wall and side walls. Further, at least some and preferably all, walls may consist of polypropylene or polystyrene or polyethylene. Yet another object is to provide recesses in or adjacent the projections and into which edge extents of the top wall sections have snap releasable interfit. The top wall sections may also have edge tabs deflectably received into the recesses. The projections are typically open at one side to allow breathing of the box interior with the exterior.

These and other objects and advantages of the invention, as well as the details of an illustrative embodiment, will be more fully understood from the following specification and drawings, in which:

DRAWING DESCRIPTION

Figure 1:
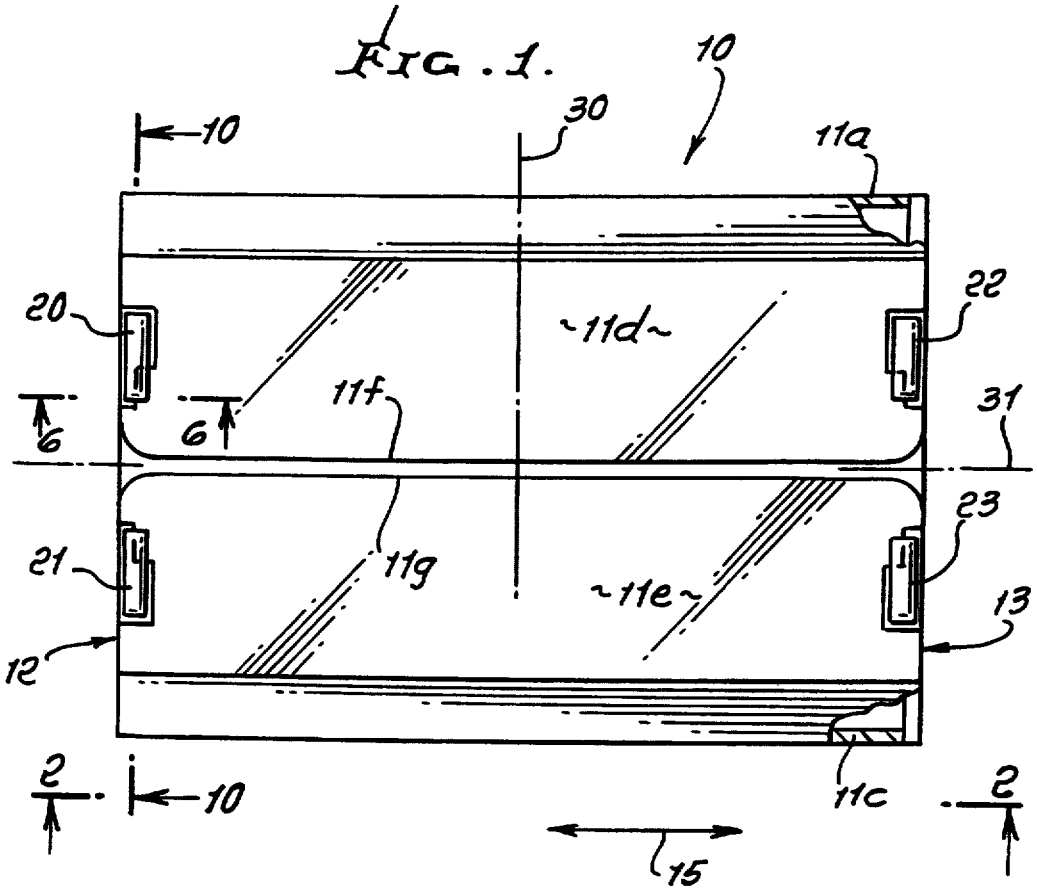
FIG. 1 is a top plan view of a produce box incorporating the invention.
Figure 3:
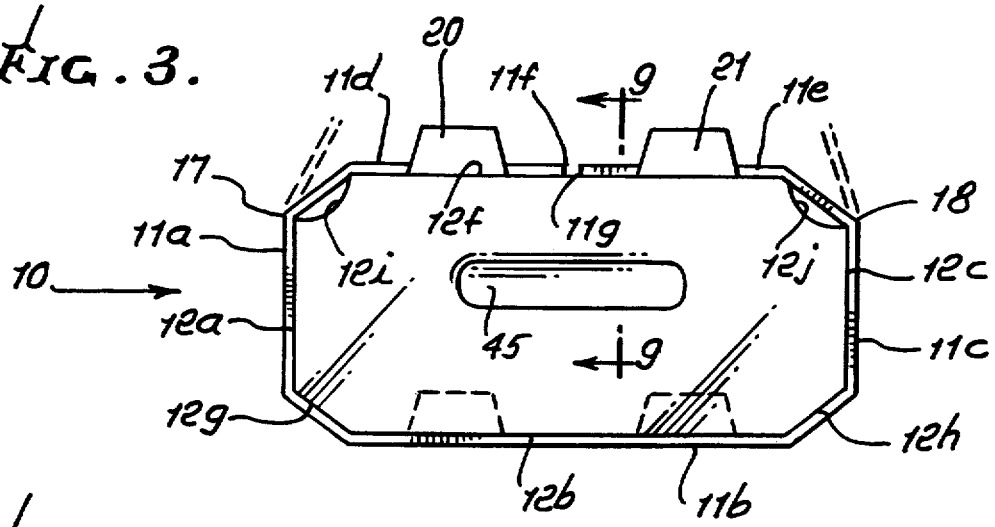
FIG. 3 is an end elevation taken on lines 3—3 of FIG. 2.
Figure 9:
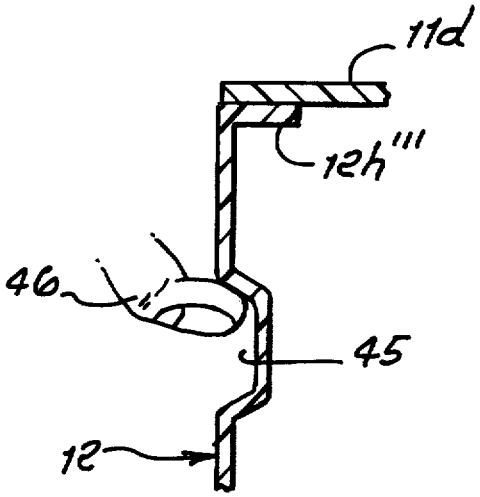
Figure 10:
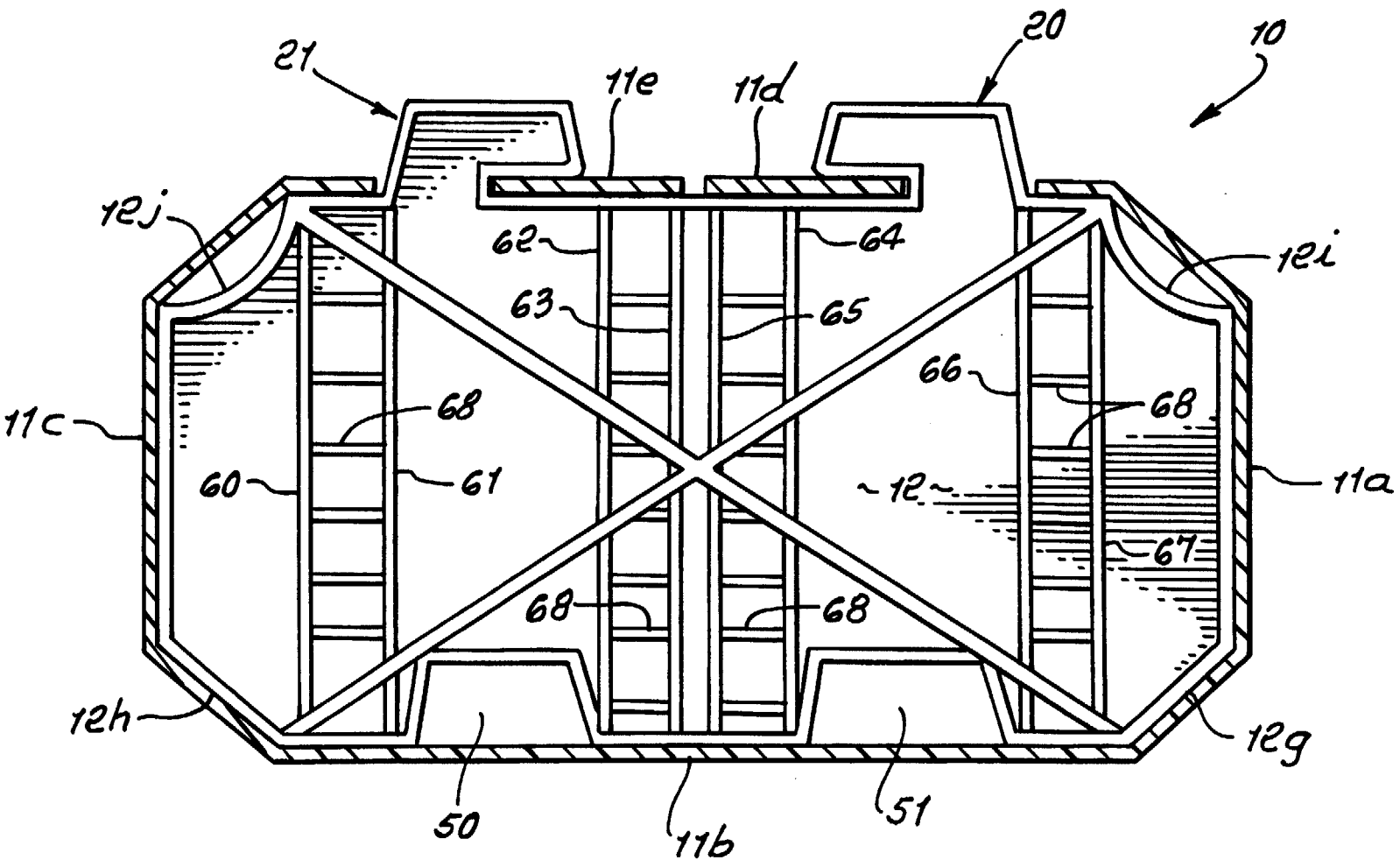

FIG. 9 is a section taken in elevation on lines 9—9 of FIG. 3; and FIGS. **9*a* and 9*b* show modified constructions; and FIG. 10 is a section taken on lines 10—10 of FIG. 1**.

DETAILED DESCRIPTION

In FIGS. 1–4, the produce box structure 10 includes box side walls **11*a* and 11*c*, box bottom wall 11*b* and box end walls 12 and 13, which are alike, but mirror images of one another. Walls 11*a*, 11*b* and 11*c*** preferably have the same overall thickness $t_1$ which is substantially less than the overall thickness $t_2$ of each of the end walls. Thickness $t_2$ is substantially greater than $t_1$, and these may have the following values:

$t_1 = 5/32$ inch (between 4/32 & 6/32)

$t_2 = 19/32$ inch (between 18/32 & 20/32)

Figure 4:
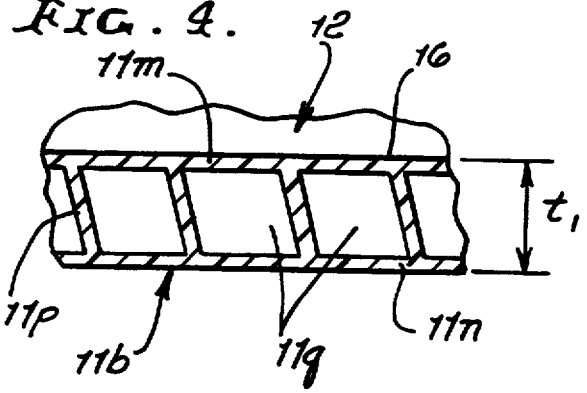
FIG. 4 is an enlarged section taken on lines 4—4 of FIG. 2.

Walls **11*a*, 11*b* and 11*c* preferably form a continuous rectangular strip or sheet 11 folded to have opposite edge portions which overlap and fit flatly against peripheral edges 12*a*, 12*b* and 12*c*, and 13*a*, 13*b* and 13*c* of the end walls. Opposite ends of the strip 11 are indicated at 11*f* and 11*g*, at the top of the box, and terminating the box top walls shown at 11*d* and 11*e*. Corners of the end walls 12 and 13 are similarly beveled, as seen at 12*g–h*, whereby strip 11 also folds to conform to and fit flatly against beveled edges 12*g* and 12*h*, as seen in FIG. 3. Strip 11, as seen in FIG. 4, typically consists of plastic, and may be internally reinforced. See thin inner and outer panels 11*n* and 11*m* which extend in parallel relation and interconnected by walls 11*p* that extend lengthwise of the box, i.e., in direction of arrows 15 in FIG. 1. Elongated, cell-like openings 11*a* are formed between the webs, and the sheet is thereby foldable to engage lower corner bevels 12*g* and 12*h* as referred; and also to extend at 11*h* and 11*i* over relieved (concave) corners 12*i* and 12*j* of end wall 12. Wall 13 has similar construction. All walls 11, 12 and 13 of the box consist of plastic, as for example polypropylene, polystyrene or polyethylene. Walls 11*a–11e* have cellularly honeycomb construction that is foldable. Ends of walls 11*n*, 11*m* and 11*p* is about 1/64 inch in thickness; and walls 11*p* are angled at about 25° from normal to walls 11***n* and 11*m*, enabling panel folding. Cells 11*g* have parallelogram cross sections in planes normal to cell length dimensions.

Adhesive (for example epoxy) indicated at 16 in FIG. 4 is employed to attach the edge portions of the side and bottom walls 11*a*–11*c* to the end wall peripheral edges 12*a*–12*c* and 13*a*–13*c*, as referred to above. The top walls 11*d* and 11*e* are not adhesively connected to the tops 12*f* and 13*f* of the end walls 12 and 13, whereby they can be elevated, by hinging at locations 17 and 18 adjacent the relieved corners 12*i* and 12*j* and 13*i* and 13*j* of the end walls.

Figure 2:
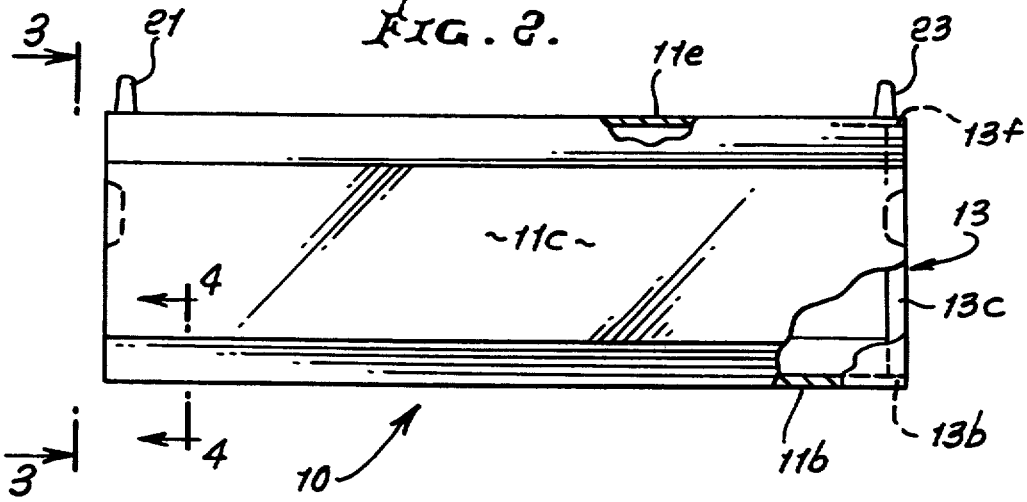
FIG. 2 is an elevation taken on lines 2—2 of FIG. 1.

Projections 20, 21, 22, and 23 are formed on the end walls 12 and 13 to which the top walls or wall sections 11*d* and 11*e* are releasably connectible, to hold such top wall sections in down position, closing the box, as shown in FIGS. 1–3. Projections 20 and 22 are the same but mirror images with respect to upright, lateral plane 30; projections 21 and 23 are likewise the same but mirror images with respect to plane 30; and projections 20 and 21 are alike but mirror images of one another with respect to upright longitudinal plane 31, and projections 22 and 23 are also alike but mirror images with respect to plane 31.

Figure 6:
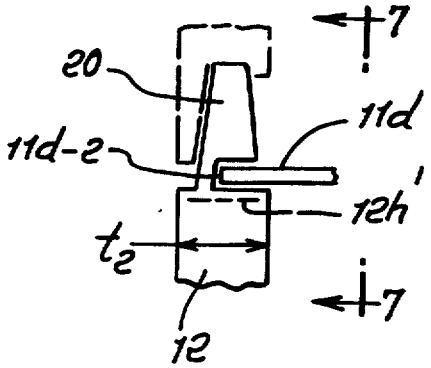
FIG. 6 is a section taken in elevation on lines 6—6 of FIG. 1.
Figure 5:
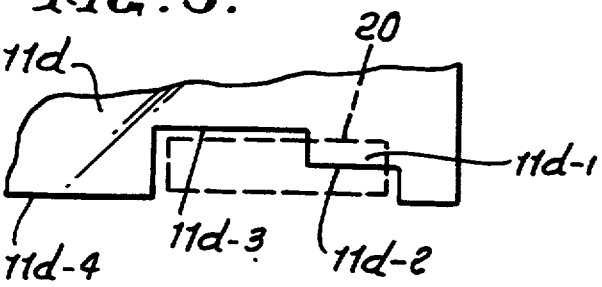
FIG. 5 is an enlarged fragmentary plan view showing retention notching of a lid, as also seen in FIG. 1.
Figure 7:
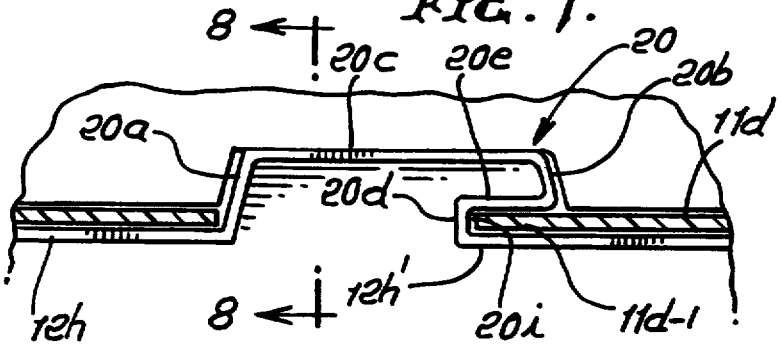
FIG. 7 is a side elevation taken on lines 7—7 of FIG. 6.

In FIGS. 6–7, the representative projection 20 shown is molded in integral relation with the top horizontal flange 12*h*' of end wall 12. The projection includes upright and inclined opposite end flanges 20*a* and 20*b*, top flange 20*c*, short end flange 20*d* offset toward end flange 20*c*, and horizontal short flange 20*e* interconnecting the top of 20*d* with the bottom of 20*b*. flanges 20*e* and 12*h* are vertically spaced and form a sidewardly slot or recess 20*i* therebetween to closely receive a tongue portion 11*d*-1 of top wall 11*d*, that tongue portion also shown in FIG. 5 as formed by two notches 11*d*-2 and 11*d*-3 cut sidewardly into wall 11*d* from its edge 11*d*-4. Similar notched edges and projection structures are formed at each of the locations of projections 21, 22, and 23, for receiving and retaining edge extents of top walls 11*d* and 11*e*, as seen in FIG. 1.

Figure 8:
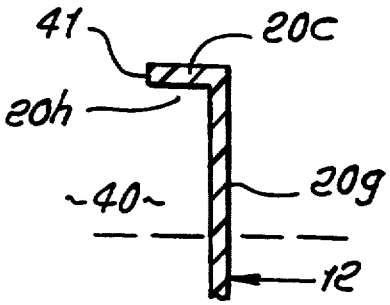
FIG. 8 is a section taken on lines 8—8 of FIG. 7.

Projection 20 also includes one side wall 20*g* integral with flanges 20*a* through 20*e*, to integrate same, structurally. Wall 20*g* is closest to the outermost side of wall 12 and merges therewith, as is clear from FIG. 8. This provides an opening 20*h* below flange 20*c* that communicates with the box interior 40, allowing "breathing" or ventilation of produce in the box, with the exterior, as well as a finger grip lip 41 on top flange 20*c*, for lifting force application, via the projection, and projection retention, while the lid tongues, as at 11*d*-1, are being interfitted into slots, as at 20*i*. Otherwise, such interfitting can be more difficult, due to bowing of the lid. Use of the cellular plastic top walls, as described, facilitates such interfitting.

FIGS. 3 and 9 show horizontal slots or recesses 45 formed in the end wall, for finger gripping to enable box lifting and moving. See the user's finger 46. A similar recess is formed in end wall 13.

Figure 9A:
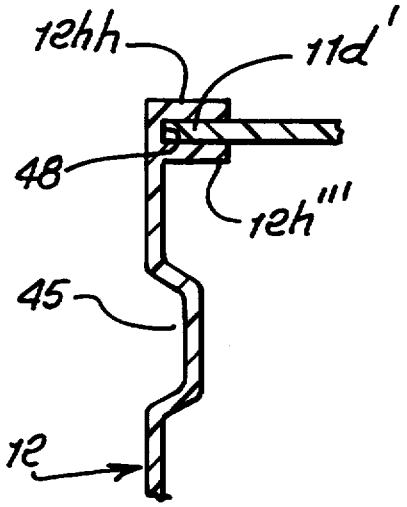
Figure 9B:
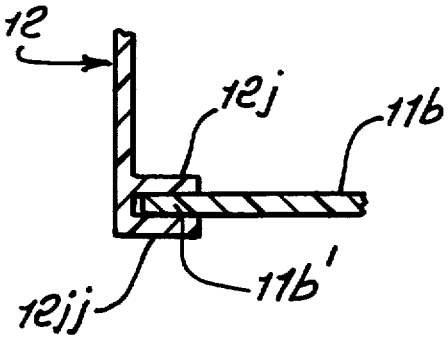

FIG. 9*a* shows provision of double flanges 12*h*''' and 12*hh* for reception of the edge extent 11*d*' of the top wall into the slot 48 formed between such double, vertically offset, parallel flanges 12*h* and 12*hh*. Such double flanges 12*j* and 12*jj* may also be formed at the bottom of end wall 12 (see FIG. 9*b*) for reception of edge extent 11*b*' of bottom wall 11*b*; and such double flanges may also be formed at opposite ends of walls 12 and 13 to receive edge extents of side walls 11*a* and 11*c*.

Two upward recesses, as at 50 (see FIG. 7), are formed in each end wall 12 and 13, and sized to receive projections, such as at 20 and 21, on the next lower box, for stacking.

FIG. 10 shows such recesses, which are downwardly open, i.e., not covered by bottom wall 11*b*. FIG. 10 also shows flange-type ribbing 60-70 on the inner side of end wall 12, for stiffening.

The box side walls, bottom wall and top wall sections may consist of the known product COR-X, manufactured by Primex Plastics, Richmond, Ind.

I claim:

1. In a produce box structure, the combination comprising a) box side walls, bottom wall, and top wall sections, and two end walls, said end walls being substantially rigid for supporting said side walls and bottom wall, b) the end walls having peripheral edge portions, said bottom wall and side walls overlapping certain of the peripheral edge portions of the end walls and joined thereto, c) all of said walls consisting of lightweight plastic material, the bottom wall, side walls and top wall sections defined by thin inner and outer planar sheets and spaced parallel webs interconnecting said sheets, said webs extending directionally lengthwise longitudinally toward said end walls, whereby lengthwise longitudinally extending elongated cells are formed by said inner and outer sheets and webs, d) the side walls being integral with the top wall sections, whereby the top wall sections are hingedly connected to the side walls, respectively, and may be folded about longitudinal axes to be opened away from said end walls, e) and projections on said end walls, to which said top wall sections are releasably connectible, f) said bottom wall, side walls and top wall sections define a continuous single wall structure, g) said projections defining recesses into which edge extents of said top wall sections have snap interfit, said recesses being sidewardly open, h) said edge extents defining edge tabs deflectably received into said recesses, said tabs including portions of said planar sheets and spaced parallel webs, multiple of said webs projecting sidewardly into at least one recess.

2. The combination of claim 1 wherein said peripheral edge portions of the end walls define flange structure joined in overlapping relation to edge extents of said bottom wall and side walls.

3. The combination of claim 1 wherein said peripheral edge portions of the end walls define channels receiving edge extents of said bottom wall and side walls.

4. The combination of claim 1 wherein at least one of said walls consist of polypropylene.

5. The combination of claim 4 wherein all of said walls consist of polypropylene.

6. The combination of claim 1 wherein at least some of said walls consist of plastic material selected from the group consisting of polyethylene and polystyrene.

7. The combination of claim 6 wherein all of said walls consist of plastic material selected from said group.

8. The combination of claim 1 wherein said wall sections define L-shaped edge notches adjacent said tabs.

9. The combination of claim 1 wherein the cells have parallelogram cross sections in planes normal to cell length dimensions.

* * * * *